US006637409B2

(12) United States Patent
Brenk et al.

(10) Patent No.: US 6,637,409 B2
(45) Date of Patent: Oct. 28, 2003

(54) FUEL INJECTION DEVICE FOR INTERNAL COMBUSTION ENGINES

(75) Inventors: Achim Brenk, Kaempfelbach-Bilfingen (DE); Wolfgang Klenk, Loechgau (DE); Uwe Gordon, Markgroeningen (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/069,569

(22) PCT Filed: Jun. 26, 2001

(86) PCT No.: PCT/DE01/02355

§ 371 (c)(1),
(2), (4) Date: Jun. 13, 2002

(87) PCT Pub. No.: WO02/01069

PCT Pub. Date: Jan. 3, 2002

(65) Prior Publication Data

US 2002/0170535 A1 Nov. 21, 2002

(30) Foreign Application Priority Data

Jun. 27, 2000 (DE) ..... 100 31 278

(51) Int. Cl.[7] ..... F02M 37/04; F15B 13/44
(52) U.S. Cl. ..... 123/467; 137/625.69
(58) Field of Search ..... 123/467, 446–7; 137/625.64, 625.66, 625.69

(56) References Cited

U.S. PATENT DOCUMENTS 4,275,865 A * 6/1981 Turner ..... 137/625.66
4,676,273 A * 6/1987 Stoltman ..... 137/625.61
4,745,898 A * 5/1988 Egler et al. ..... 123/300
5,911,245 A * 6/1999 Weber ..... 137/625.65
5,975,139 A * 11/1999 Carroll et al. ..... 137/625.64
6,067,955 A * 5/2000 Boecking ..... 123/299
6,076,800 A * 6/2000 Heinz et al. ..... 251/129.06

FOREIGN PATENT DOCUMENTS

DE 19701879 * 7/1998 ..... F02M/63/00
DE 19716221 * 10/1998 ..... F02M/45/02

* cited by examiner

*Primary Examiner*—Thomas N. Moulis
(74) *Attorney, Agent, or Firm*—Ronald E. Greigg

(57) ABSTRACT

In a fuel injection system for internal combustion engines, including an electronically triggered control valve with an axial through bore, which is divided by two valve seats into three annular chambers, to which respectively a supply line for fuel at high pressure, a high-pressure line leading away to an injection valve, and a relief line are connected, and having a control piston, which is guided in the through bore and which has two valve sealing faces cooperating with the two valve seats, respectively, the control piston according to the invention has a further valve sealing face, which cooperates with the first valve seat and whose spacing from the first valve sealing face is at least equal to the spacing between the second valve sealing face and the second valve seat when the first sealing seat is closed. A communication between the supply line and the relief line is thus reliably prevented.

20 Claims, 4 Drawing Sheets

FUEL INJECTION DEVICE FOR INTERNAL COMBUSTION ENGINES

CROSS-REFERENCE TO RELATED APPLICATIONS

This application is a 35 USC 371 application of PCT/DE 01/02355 filed on Jun. 26, 2001.

BACKGROUND OF THE INVENTION

1. Field of the Invention

This invention is directed to an improved fuel injection system including an electronically triggered control valve.

2. Description of the Prior Art

One fuel injection system of the type with which this invention is concerned is known from German Patent Disclosure DE 197 01 879 A1 and uses an electrically triggered 3/2-way control valve for controlling the injection times and quantities; this control valve has a control piston, guided in an axial through bore, that connects a high-pressure line leading to an injection valve to a supply line, which delivers fuel from a high-pressure reservoir (common rail), or to a relief line in alternation. To that end, the through bore is subdivided by two valve seats into three annular chambers, into which the supply line, the high-pressure line and the relief line each discharge. Upon a stroke motion, the control piston closes one valve seat as it uncovers the other valve seat. To that end, the control piston has two valve sealing faces, cooperating with the valve seats; the spacing between valve sealing faces is greater than the spacing between the two valve seats. The supply line, that is, the high-pressure side, therefore briefly communicates directly with the relief line, that is, with leak fuel, during a stroke motion of the control piston, so that some of the fuel is diverted via the relief line. The diverted quantity is dependent on the pressure prevailing in the high-pressure reservoir and is sometimes considerably higher than the injection quantity.

SUMMARY OF THE INVENTION

The fuel injection system according to the invention for internal combustion engines has the advantage over the prior art that by means of a further valve sealing face, a direct communication between the high-pressure side and the leak fuel is reliably prevented. This leads to markedly reduced diversion quantities and increases the hydraulic efficiency.

In a pressure-controlled injection valve, the control valve can be used to connect an injection cross section of the injection valve, which can be opened by a valve needle of the injection valve, to either the supply line or the relief line. The requisite pumping quantity of the high-pressure fuel pump that supplies the high-pressure side, such as a high-pressure reservoir, is thus less, and furthermore the temperature load on the fuel tank system is reduced because of reduced return quantities at a high diversion temperature.

In a pressure- and cross-section-controlled injection valve, the control valve can also be used to control the injection cross section. Advantageously, the same valves can be used to control both the injection quantity and the injection cross section.

BRIEF DESCRIPTION OF THE DRAWINGS

Two exemplary embodiments of the fuel injection system according to the invention for internal combustion engines are shown in the drawing and will be explained in further detail in the ensuing description. Shown are.

DESCRIPTION OF THE PREFERRED EMBODIMENTS

Figure 1:
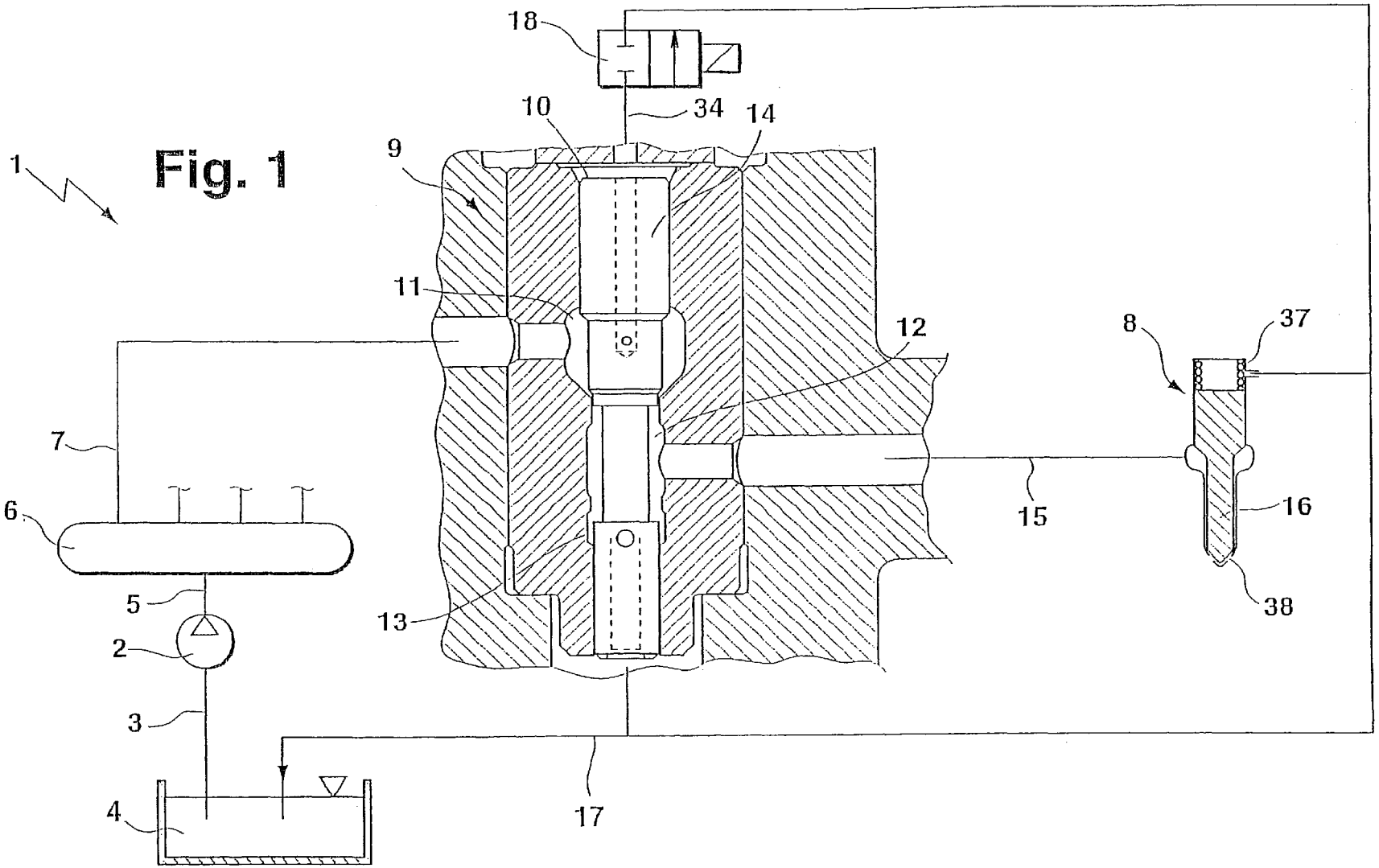
FIG. 1, a first exemplary embodiment in a schematic overview, showing a control valve used for the injection in an enlarged detail.

The first exemplary embodiment, identified as a whole by reference numeral 1 in FIG. 1, of a fuel injection system for internal combustion engines has a high-pressure fuel pump 2, which on the intake side communicates via a fuel feed line 3 with a fuel-filled low-pressure chamber 4 and on the compression side via the feed line 5 with a high-pressure reservoir (common rail) 6. From this high-pressure reservoir 6, the fuel at high pressure is carried away via supply lines 7 to the individual pressure-controlled injection valves 8 protruding into the combustion chamber of the internal combustion engine to be supplied. For controlling the injection event, each injection valve 8 is assigned a respective electrically actuatable control valve 9 in the form of a 3/2-way valve.

The control valve 9 has an axial through bore 10, with an upper, middle and lower annular chamber 11, 12, 13, respectively, and as a control valve member, it has a control piston 14 guided in the through bore 10. The supply line 7 discharges into the upper annular chamber 11, and from the middle annular chamber 12 a high-pressure line 15 leads away, which in a known manner discharges into an injection cross section of the injection valve 8 that can be opened by a valve needle 16 of the injection valve 8. The control piston 14 connects the middle annular chamber 12 in alternation with the upper annular chamber 11 or with the lower annular chamber 13, from which latter a relief line 17 leading to the low-pressure chamber 4 leads away. The adjusting motion of the control piston 14 is controlled by a magnet valve 18, which is triggered by an electric control unit (not shown) that processes many operating parameters of the engine to be supplied.

Figure 2:
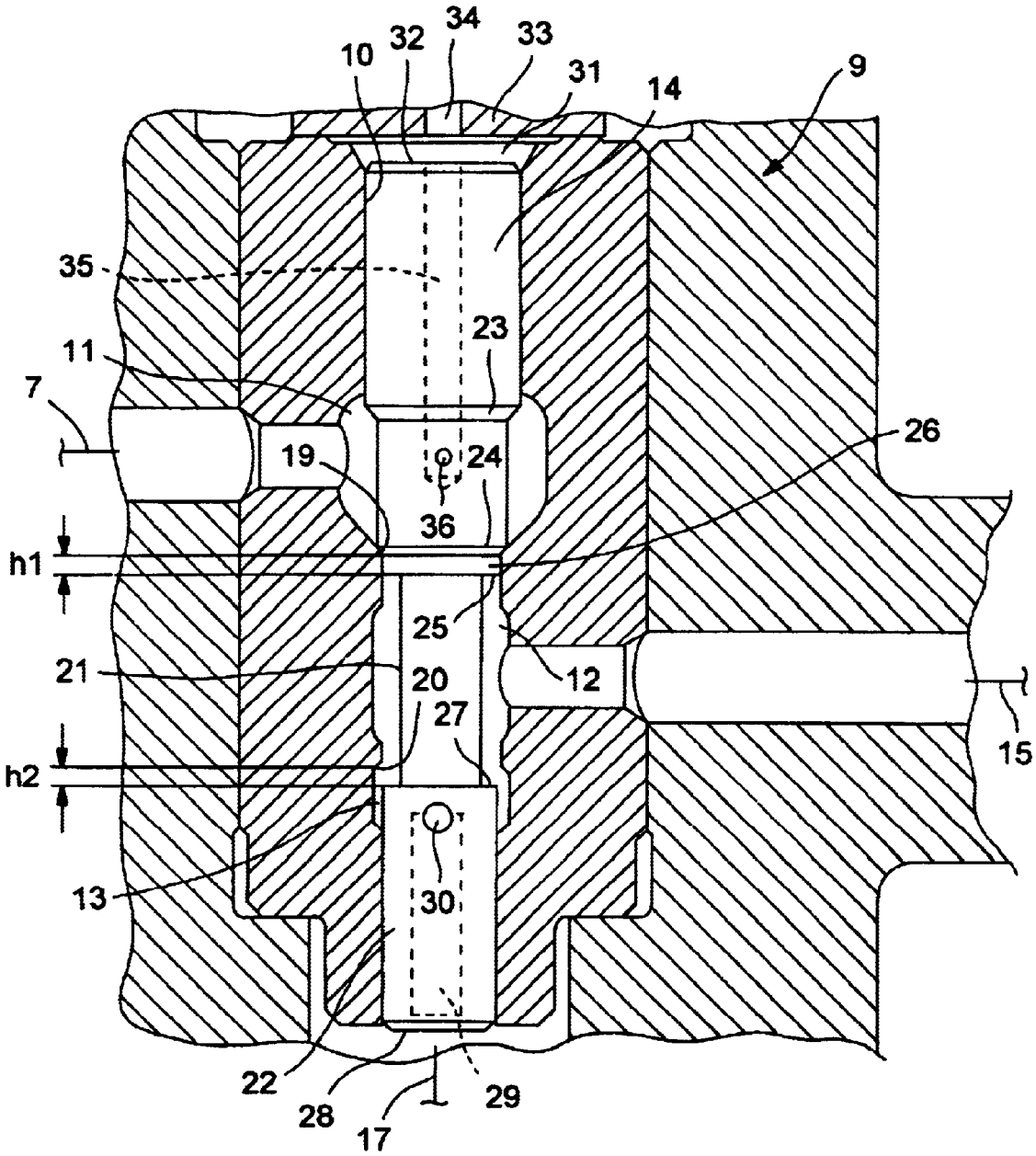
FIG. 2, an enlarged sectional view through the control valve of FIG. 1.

As the sectional view, shown enlarged in FIG. 2, of the control valve 9 shows, the middle annular chamber 12 is separated from the upper annular chamber 11 by a conical first valve seat 19 and from the lower annular chamber 13 by a second valve seat 20. The cross section of the control piston 14 narrows from its upper end, initially via two conically embodied upper annular end faces, to a middle piston portion 21, compared to which a slide head 22 on its lower end is widened. The diameter of the middle piston portion 21 is smaller than the opening diameter of either the upper or the lower valve seat 19, 20. The first upper annular end face 23 is provided in the region of the upper annular chamber 11, and the second upper annular end face forms a first conical valve sealing face 24, with which the first valve seat 19 cooperates. This first sealing seat, formed between the valve sealing face 24 and the first valve seat 19, closes off the upper annular chamber 11 from the middle annular chamber 12. Adjoining [bordering on] its conical first valve sealing face 24 at the bottom, the control piston 14 has a further valve sealing face 25, which is formed by the lower edge of an annular collar 26. The annular collar 26 is guided with little play in the first valve seat 19 by paired grinding, and its lower edge together with the first valve seat 19 forms a slide valve. The spacing of the valve sealing face 25 from the first valve sealing face 24, that is, the length of the annular collar, is marked h1. Cooperating with the second valve seat 20 is a second valve sealing face 27, embodied as a valve control edge, on the slide head 21, and the second sealing cross section formed between them closes off the communication between the middle and lower annular chambers 12, 13. The closing stroke of the slide valve formed by the second valve seat 20 and the valve sealing face 27 is marked h2, and it is at most as long as the length h1; that is, $h1 \leqq h2$. The diversion of fuel from the lower annular chamber 13 into the relief line 17 is effected via a blind bore 29, which is open toward the lower end face 28 of the control piston 14 and from which a transverse bore 30, embodied as a throttle restriction, leads away and discharges into the lower annular chamber 13.

A hydraulic work chamber 31 is provided for actuating the control piston 14; it is defined in the through bore 10 by the upper end face 32 of the control piston 14 and toward the magnet valve 18 by a shim 33. A relief conduit 34 leading away from the work chamber 31 is provided in this shim 33 and can be made to communicate via the magnet valve 18 with the low-pressure chamber 4 (FIG. 1). For filling the work chamber 31 with fuel that is at high pressure, a filling bore 35 with a transverse bore with an opening 36 is provided in the control piston 14; its cross section is less than the cross section of the relief conduit 34 and which therefore forms a throttle restriction. The transverse opening 36 leads away below the first annular end face 23 of the control piston 14, so that via the filling bore 35, the work chamber 31 communicates at all times with the supply line 7.

The fuel injection system 1 shown in FIGS. 1 and 2 functions as follows. Upon startup of the system, initially, via the high-pressure fuel pump 2, a high fuel pressure is built up in the common high-pressure reservoir 6, and this pressure is propagated via the various supply lines 7 as far as the respective control valves 9. Before the onset of the injection phase, the magnet valve 18 is rendered currentless, so that the relief conduit 34 is closed. In the process, the work chamber 31 is filled with fuel at high pressure via the filling bore 35 and presses the control piston 14, because of the ratio in area between the end face 32 and the first annular end face 23, by the first valve sealing face 24 against the first valve seat 19. The communication between the supply line 7 and the high-pressure line 15 that discharges at the injection cross section of the injection valve 8 is thus closed. At the same time, the second sealing cross section between the second valve sealing face 27 and the second valve seat 20 is opened, so that the pressure in the high-pressure conduit 15 can decrease into the relief line 17 down to a certain residual pressure. If an injection is to take place at the injection valve 8, then initially current is delivered to the magnet valve 18, thus uncovering the relief conduit 34 to the low-pressure chamber 4. Since the cross section of the relief conduit 34 is greater than that of the transverse opening 36 in the filling bore 35, the pressure in the work chamber 31 very quickly decreases into the low-pressure chamber 4 via the relief conduit 34. The high fuel pressure prevailing at the annular end face 23 now suffices to displace the control piston 14. In this opening stroke motion, the first valve sealing face 24 initially moves from the first valve seat 19, and despite this opened first sealing seat, the valve sealing face 25 keeps the communication with the middle annular chamber 12 closed. After a stroke h2, the second sealing seat is closed by contact of the valve control edge 27 with the second valve seat 20. Either simultaneously, if h1=h2, or only after an additional stroke, if h1>h2, the valve sealing face 25 uncovers the first seating seat, and the fuel at high pressure located in the supply line 7 flows along the middle piston portion 21 into the high-pressure conduit 15 to the injection valve 8, where in a known manner it lifts the valve needle 16 from its needle seat counter to the restoring force of a valve spring 37, so that the fuel at the injection valve 8 is injected via injection ports 38 into the combustion chamber of the engine to be supplied.

The high-pressure injection at the injection valve 8 is terminated by switching the magnet valve 18 to be currentless again. Because the relief conduit 34 is now closed, a closing pressure can build up again in the work chamber 31 via the filling bore 35, so that the valve sealing face 25 closes the first valve seat 19 again, and thus the communication of the supply line 7 with the high-pressure conduit 15 is again closed.

Either simultaneously, if h1=h2, or only after an additional stroke, if h1>h2, the second sealing seat between the valve control edge 27 and the second valve seat 20 is opened again, so that the high fuel pressure located in the high-pressure conduit 15 very rapidly decreases into the relief line 17, resulting in fast needle closure at the fuel injection valve 8.

Figure 3:
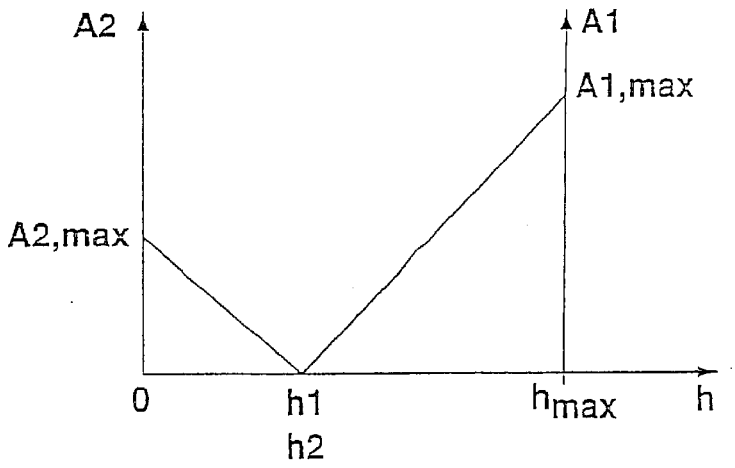
FIGS. 3 and 4, graphs that show opening cross sections of the control valve of FIG. 2 as a function of its stroke motion.

In the graph of FIG. 3, the geometric opening cross sections A1, A2 at the first and second valve seats 19, 20 are plotted as a function of the stroke motion of the control piston 14; h1=h2. Not until the control piston 14 closes the communication between the high-pressure line 15 and the relief line 17, at a stroke h1=h2, does the control piston 14 open the communication between the supply line 7 and the high-pressure line 15.

Figure 4:
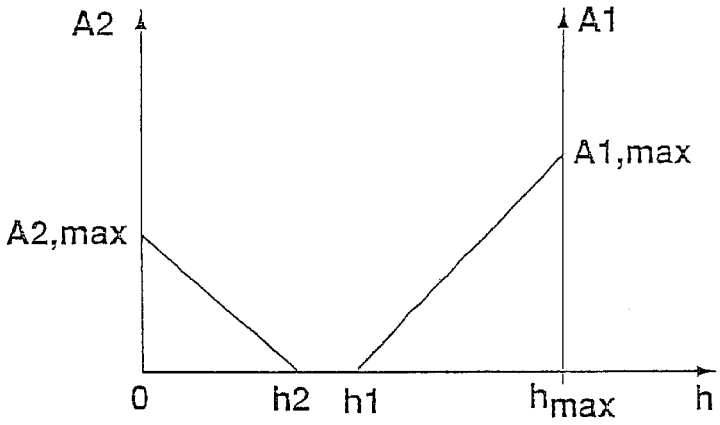

The course of the geometric opening cross sections A1, A2 when h1>h2 is plotted in the graph in FIG. 4. In an intermediate stroke phase between h2 and h1, both opening cross sections A1, A2 are closed, until, at a stroke h1, the control piston 14 then opens the communication between the supply line 7 and the high-pressure line 15.

Figure 5:
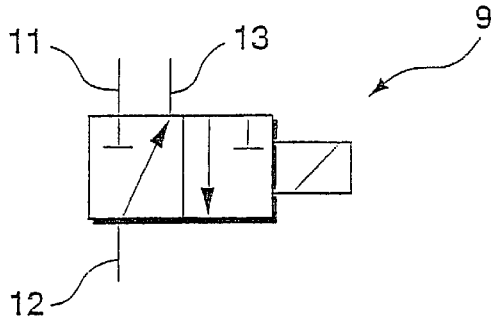
FIG. 5, the block circuit diagram of the control valve of FIG. 2.

FIG. 5 shows the block circuit diagram of the control valve 9, acting as a 3/2-way valve, in which the second annular chamber 12 communicates either in the currentless state with the third annular chamber 13 or in the state when current is supplied with the first annular chamber 11.

Figure 6:
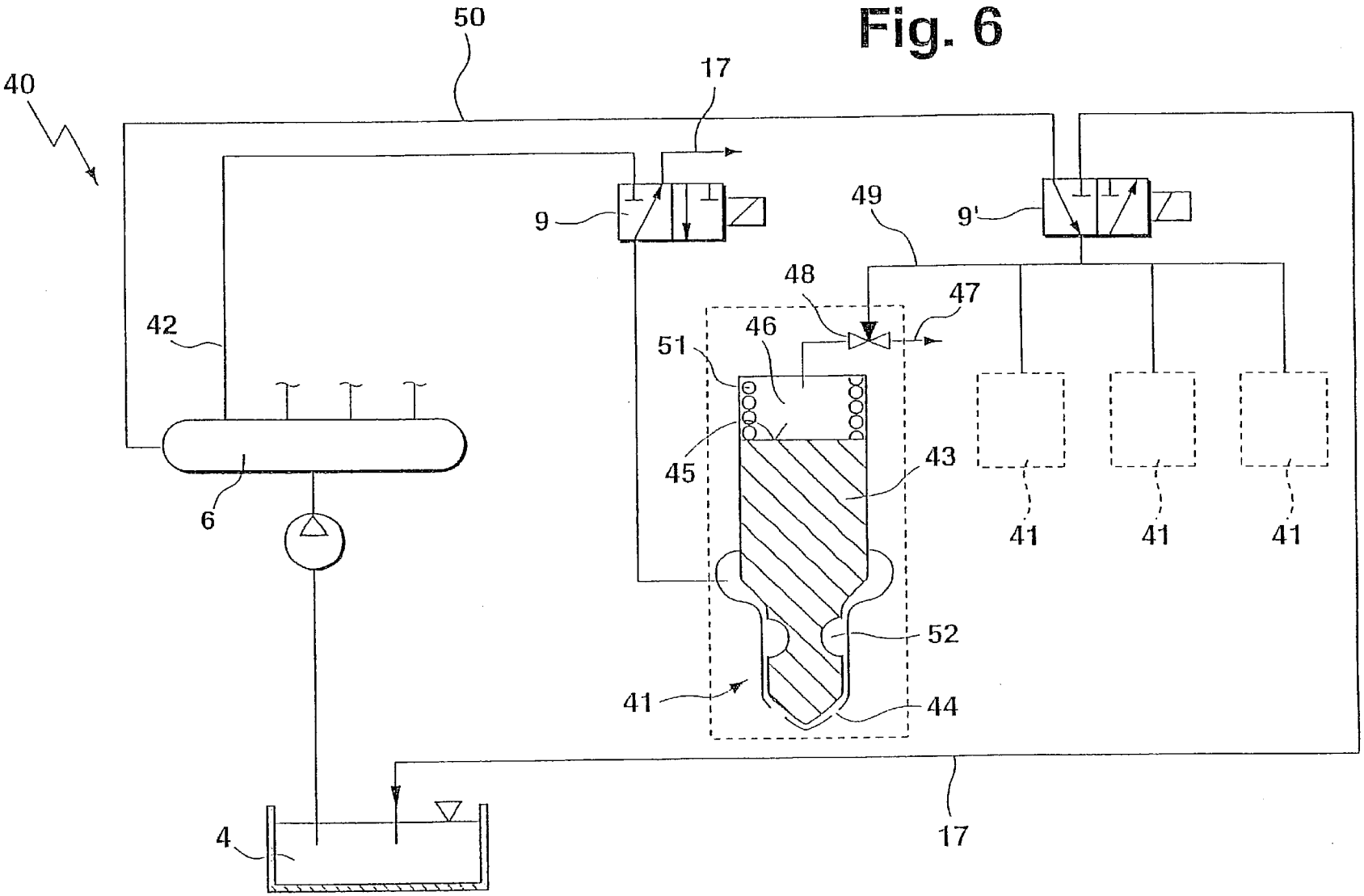
FIG. 6, a second exemplary embodiment, in which the control valve of FIG. 2 is used for controlling the cross section of injection valves.

In FIG. 6, 40 represents a second exemplary embodiment of a fuel injection system for internal combustion engines with pressure- and cross-section-controlled injection valves 41. From the high-pressure reservoir 6, an injection line 42 leads away to each injection valve 41; in a known manner, in the injection valve 41, this line discharges up to an injection cross section of the injection valve 41 that can be opened by a valve needle 43 of the injection valve 41. The end face 45 of the nozzle needle 43 remote from the injection ports 44 of the injection valve 41 defines a chamber 46, which can be made to communicate with the low-pressure chamber 4 via a relief line 47. This communication is controlled hydraulically by a 2/2-way control valve 48, whose control line, designed as a high-pressure line 49, can be made to communicate, via the control valve 9', with a supply line 50 of the high-pressure reservoir 6 or with the relief line 17. The injection is controlled by the control valve 9 in the injection line 42. When the control line is subjected to high pressure, that is, when there is no current supplied to the control valve 9', the 2/2-way control valve 48 is closed.

Supplying current to the control valve 9 causes the valve needle 43 to lift from its needle seat via a pressure increase, counter to the restoring force of a valve spring 51, so that the fuel at the injection valve 41 is injected via the injection ports 44 into the combustion chamber of the engine to be supplied. Because there is no current to the control valve 9', the 2/2-way control valve 48 is closed, and therefore a pressure increase occurs in the fuel enclosed in the chamber 46, and this pressure increase serves to control the injection cross section. If supplying current to the control valve 9' causes the pressure in the high-pressure line 49 to be reduced via the relief line 17, then the 2/2-way control valve 48 opens, so that the pressure prevailing in the chamber 46 drops via the relief line 47. This causes a further stroke of the valve needle 43, and as a result a larger injection cross section 52 is uncovered at the valve needle 43.

By making the 3/2-way valve 9 currentless, the injection is terminated, and under the influence of the valve spring 51 the valve needle 43 closes the injection ports 44; the chamber 46 is refilled with fuel from the low-pressure chamber 4. Then the control valve 9' is switched to be without current as well.

If the common control valve 9' that controls all the injection valves 41 and the control valves 9 at the high-pressure reservoir (common rail) 6 are disposed in an integrated way, then small injector dimensions are possible. The high-pressure line 49 can either be at least partly also integrated with the high-pressure reservoir 6, which reduces the engineering effort and expense, or it can be a separately disposed control line.

The foregoing relates to preferred exemplary embodiments of the invention, it being understood that other variants and embodiments thereof are possible within the spirit and scope of the invention, the latter being defined by the appended claims.

What is claimed is:

1. A fuel injection system (1; 40) for internal combustion engines, comprising an electronically triggered control valve (9; 9') having an axial through bore (10), which is divided by two valve seats (19, 20) into three annular chambers (11, 12, 13), a supply line (7; 50) for fuel at high pressure, a high-pressure line (15; 49) leading away to an injection valve (8; 41), and a relief line (17) connected respectively to said three annular chambers (11, 12, 13), a control piston (14) guided in the through bore (10) and having two valve sealing faces (24, 27) cooperating with the two valve seats (19, 20), respectively, and a further valve sealing face (25) on said control piston cooperating with the first valve seat (19), the spacing (h1) from the first valve sealing face (24) to the further valve sealing face (25) being at least equal to the spacing (h2) between the second valve sealing face (27) and the second valve seat (20) when the first sealing seat is closed.

2. The fuel injection system of claim 1, wherein the spacing (h1) of the further valve sealing face (25) from the first valve sealing face (24) when the first sealing seat is closed is greater than the spacing (h2) between the second valve sealing face (26) and the second valve seat (20).

3. The fuel injection system of claim 1, wherein the further valve sealing face (25) is formed by an annular collar (26) on the control piston (14).

4. The fuel injection system of claim 2, wherein the further valve sealing face (25) is formed by an annular collar (26) on the control piston (14).

5. The fuel injection system of claim 3, wherein the annular collar (26) adjoins the first valve sealing face (24).

6. The fuel injection system of claim 4, wherein the annular collar (26) adjoins the first valve sealing face (24).

7. The fuel injection system of claim 1, wherein the second valve sealing face (27) and the second valve seat (20) together form a slide valve.

8. The fuel injection system of claim 2, wherein the second valve sealing face (27) and the second valve seat (20) together form a slide valve.

9. The fuel injection system of claim 4, wherein the second valve sealing face (27) and the second valve seat (20) together form a slide valve.

10. The fuel injection system of claim 5, wherein the second valve sealing face (27) and the second valve seat (20) together form a slide valve.

11. The fuel injection system of claim 1, wherein the first valve sealing face (24) and/or the first valve seat (19) taper conically in the closing direction of the control piston (14).

12. The fuel injection system of claim 2, wherein the first valve sealing face (24) and/or the first valve seat (19) taper conically in the closing direction of the control piston (14).

13. The fuel injection system of claim 4, wherein the first valve sealing face (24) and/or the first valve seat (19) taper conically in the closing direction of the control piston (14).

14. The fuel injection system of claim 5, wherein the first valve sealing face (24) and/or the first valve seat (19) taper conically in the closing direction of the control piston (14).

15. The fuel injection system of claim 1, wherein the supply line (7; 50) is connected to a high-pressure reservoir (6).

16. The fuel injection system of claim 1, wherein an injection cross section of the injection valve (8; 41) that can be opened by a valve needle (16; 43) of the injection valve (8; 41) can be made to communicate via the control valve (9) with either the supply line (7) or the relief line (17).

17. The fuel injection system of claim 2, wherein an injection cross section of the injection valve (8; 41) that can be opened by a valve needle (16; 43) of the injection valve (8; 41) can be made to communicate via the control valve (9) with either the supply line (7) or the relief line (17).

18. The fuel injection system of claim 15, wherein an injection cross section of the injection valve (8; 41) that can be opened by a valve needle (16; 43) of the injection valve (8; 41) can be made to communicate via the control valve (9) with either the supply line (7) or the relief line (17).

19. The fuel injection system of claim 1, wherein the control valve (9') is provided for controlling the cross section of the injection valve (41).

20. The fuel injection system of claim 16, wherein the control valve (9') is provided for controlling the cross section of the injection valve (41).

* * * * *